US009528373B2

(12) United States Patent
Van Den Brink et al.

(10) Patent No.: US 9,528,373 B2
(45) Date of Patent: Dec. 27, 2016

(54) ROTARY DRIVE SYSTEM HAVING A CAM FOLLOWER WITH DETACHABLE WHEEL SUPPORT

(71) Applicants: Christopher Ralph Van Den Brink, Puttershoek (NL); Hendrik Marinus Kroonen, Zwijndrecht (NL)

(72) Inventors: Christopher Ralph Van Den Brink, Puttershoek (NL); Hendrik Marinus Kroonen, Zwijndrecht (NL)

(73) Assignee: GRIEND HOLDING B.V., 's-Gravendeel (NL)

( * ) Notice: Subject to any disclaimer, the term of this patent is extended or adjusted under 35 U.S.C. 154(b) by 373 days.

(21) Appl. No.: 14/365,144

(22) PCT Filed: Dec. 12, 2012

(86) PCT No.: PCT/NL2012/050882
§ 371 (c)(1),
(2) Date: Jun. 13, 2014

(87) PCT Pub. No.: WO2013/095114
PCT Pub. Date: Jun. 27, 2013

(65) Prior Publication Data

US 2015/0000514 A1 Jan. 1, 2015

(30) Foreign Application Priority Data

Dec. 16, 2011 (NL) ..... 2007987

(51) Int. Cl.
*F01B 9/06* (2006.01)
*F01B 3/04* (2006.01)
(Continued)

(52) U.S. Cl.
CPC ..... *F01B 9/06* (2013.01); *F01B 3/0085* (2013.01); *F01B 3/04* (2013.01); *F01B 7/00* (2013.01);
(Continued)

(58) Field of Classification Search
CPC ..... F02B 71/04; F02B 75/282; F01B 3/0085; F01B 9/06; F01B 7/00
See application file for complete search history.

(56) References Cited

U.S. PATENT DOCUMENTS 1,485,627 A 3/1924 Reineke
1,703,752 A 2/1929 Reineke
(Continued)

FOREIGN PATENT DOCUMENTS

DE 37 31 786 A1 1/1989

OTHER PUBLICATIONS

International Search Report, dated May 7, 2013, from corresponding PCT application.

*Primary Examiner* — Thomas E Lazo
*Assistant Examiner* — Abiy Teka
(74) *Attorney, Agent, or Firm* — Young & Thompson

(57) ABSTRACT

A rotary drive system includes a cylinder wall, a piston axially slidable along a longitudinal axis within the cylinder wall and a piston rod extending along the longitudinal axis and projecting at a drive side of the system axially beyond the cylinder wall. The piston rod is at the drive side attached to a carrier support member. A rotatable annular cam member extends at an axial cam position that is spaced at a distance from the drive side, coaxially around the cylinder wall. A carrier carries at a support side a pair of rollers engaging on opposed cam surfaces of the cam member, the carrier extending radially outwardly from the cylinder wall from the cam position to the carrier support member and
(Continued)

being with a connecting end detachably connected to the carrier support member. The carrier includes an arm provided with a flexible section.

11 Claims, 8 Drawing Sheets

(51) Int. Cl.
*F01B 7/00* (2006.01)
*F02B 75/28* (2006.01)
*F01B 3/00* (2006.01)

(52) U.S. Cl.
CPC ..... *F02B 75/282* (2013.01); *F01B 2009/061* (2013.01)

(56) References Cited

U.S. PATENT DOCUMENTS

| | | | | |
|---|---|---|---|---|
| 9,057,323 | B2 * | 6/2015 | van den Brink | F01L 11/02 |
| 2005/0066917 | A1 * | 3/2005 | Huettlin | F01B 3/0035 123/45 A |
| 2009/0320799 | A1 | 12/2009 | Van Den Brink | |

* cited by examiner

ROTARY DRIVE SYSTEM HAVING A CAM FOLLOWER WITH DETACHABLE WHEEL SUPPORT

FIELD OF THE INVENTION

The invention relates to a rotary drive system comprising a cylinder wall, a piston axially slidable along a longitudinal axis within the cylinder wall and a piston rod extending along the longitudinal axis and projecting at a drive side of the system axially beyond the cylinder wall, the piston rod at the drive side being attached to a carrier support member, a rotatable annular cam member extending at an axial cam position that is spaced at a distance from the drive side.

BACKGROUND OF THE INVENTION

Such a propulsion system which may comprise a generator, a combustion engine, energy converter, or a hybrid drive (combined generator/engine), is known from U.S. 2009/0320799. The drive system forms within the cylinder wall a combustion chamber, driving the piston rod. A rotating cam can rotate around the cylinder wall and engages with cam rollers to transform the reciprocating linear motion into a rotary motion.

In the known rotary drive system, the drive element connected to the piston rods, in combination with the rollers can not be easily mounted on the cam and interconnecting all parts during assembly or maintenance, is relatively difficult. Furthermore, the known driver comprises three linear axial displacement supports which makes it over-determined, whereas the production tolerances of such an over determined drive system will be very high. Also, it has appeared that when during operation forces are applied on the driver, the driver will flex thus creating movements and/or high forces in the linear axial displacement support structures.

The complex construction of the known drive system interconnecting the pistons with the rotating cam results that when using oil or grease to lubricate the bearings during operation, the drive system can not simply be enclosed in order to contain the oil or grease and to protect the moving parts against the ingress of dirt. Containing the drive system in a single housing will impede accessibility to important parts of the known system, such as to the air intake, fuel injection, exhaust, etc.

From U.S. Pat. No. 1,703,752 an internal combustion engine of the opposed piston type is known in which the crank shaft is located at the end of the cylinder. The engine includes rigid rods connecting only the upper piston, the rods being connected via detachable pins. The known engine fails to provide a curved track and a cam follower and can be assembled and disassembled with relative large tolerances.

It is therefore an objective of the invention to provide a drive system comprising a rotatable annular cam member of the above referred type, wherein the carriers in combination with the cam rollers can be easily mounted onto the cam and can be easily extracted from the drive system and replaced therein, for assembly, repair or maintenance.

It is a further objective to provide a drive system whereby carrier of the rollers in combination with its three linear axial supports is not over determined.

It is again an objective to provide drive system having a housing that allows easy opening and closing, the housing providing an effective seal containing the oil in and protecting moving parts against dirt. The inventive oil enclosure should have a cover allowing easy access to important parts.

SUMMARY OF THE INVENTION

To this end the drive system according to the invention has a carrier carrying at a support side a pair of rollers engaging on opposed substantially radially oriented cam surfaces of the cam member, the carrier extending radially outwardly from the cylinder wall from the cam position to the carrier support member and being with an connecting end detachably connected to the driver support member, the carrier comprising an arm that is provided with a flexible section.

By applying a detachable carrier, the carrier on which the rollers are connected can be mounted separately on the rotating cam and can be placed together with the cam around the cylinder. After the cam and attached rollers with their respective carriers has been mounted coaxially around the cylinder, the carriers can with their connecting ends be reattached to their respective carrier support member. In this manner, the drive system of the present invention can be easily assembled and taken apart for maintenance, repair or exchange of the rollers upon wear.

By applying a carrier with flexible elements that act like hinges, such as a relatively thin steel carrier part, a carrier part of different material, a mechanical spring such as a leave spring or other constructional hinge element, the carrier construction has increased degrees of freedoms eliminating its over determination. By applying flex elements that divide the carrier into separate sections, the tolerance of the carrier and its detachable connection becomes less critical. The carrier support member has three linear support structures, the two roller linear displacement supports and the piston rod linear displacement support. The carriers have the possibility to align themselves by flexing, for instance at the narrowed down places. These narrowed down places act like hinges in carrier construction that result in a built-in degree of freedom eliminating its over-determination. The placing of the narrowed down places is so located at a point where the assembled carriers have the minimum bending forces and where tendency to buckle is low.

In one embodiment of a drive system according to the invention, a housing having an axial housing part extends radially outwardly from the carriers and surrounds the rollers and the cam member, the housing having at the drive side a first housing end member with a central opening having an inner rim supported on the cylinder wall and with at least one aperture extending around the carrier.

By applying a carrier that is formed out of separate sections, each carrying a pair of rollers between which the cam surface of the rotating cam is comprised, in combination with the housing forming an oil cover that can be mounted over the carriers and their respective rollers that engage with the rotating cam, an oil tight enclosure can be formed. After releasing the carrier from the carrier support member, the housing end part can be slid in an axial direction over the cylinder and carriers, to allow access to the cam surface. The cam surface can, together with the rollers and carriers attached to it, be axially retracted over the cylinder wall.

Preferably at the drive side a releasable cap is placed over the carrier support member so that in combination with the housing end part an effective oil containment is achieved.

In one embodiment, the drive system comprises an end plate member connected to the housing end member having a hole aligned with the aperture for accommodating the carrier and having an end plate connected to the cylinder wall (51) and forming an end face of a cylinder enclosing the piston and having a hole through which the piston projects. In this manner, the cylinder in closed in a gas tight-manner, and an oil barrier is formed for containing lubrication of the rollers.

BRIEF DESCRIPTION OF THE DRAWINGS

Some embodiments of a rotary drive system according to the present invention, will by way of non-limiting example be described referring to the accompanying drawing. In the drawing.

DETAILED DESCRIPTION OF THE INVENTION

Figure 1:
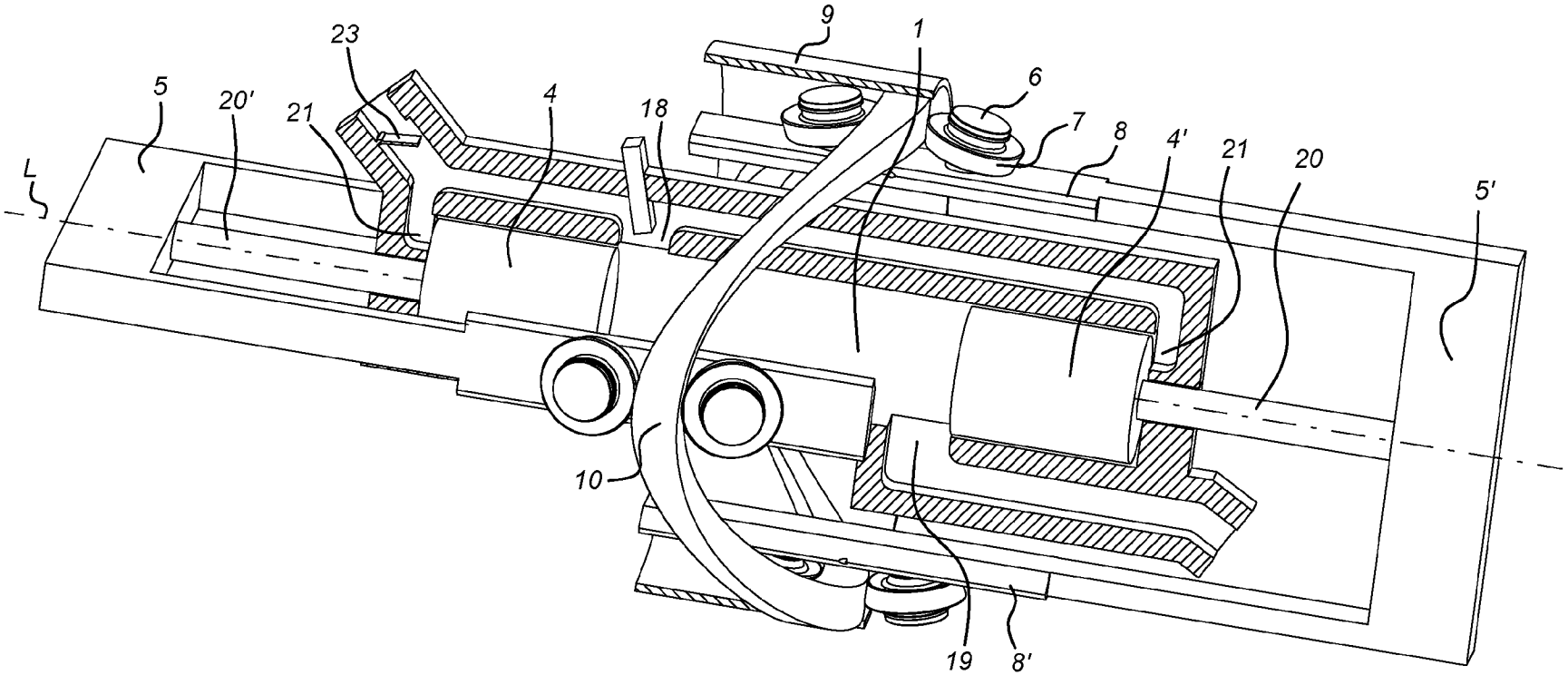
FIG. 1 shows a known rotary drive system in a partially assembled state, with a one-piece yoke-shaped drive element according to the prior art.

FIG. 1 shows a known embodiment of a rotary drive system according to US 2009/0320799, in the form of a cam engine wherein an annular cam track 10 is situated coaxially around a cylinder 1. The cam track 10 is acted on by cam rollers 7 supported on carrier arms 8, 8' on the inside of the cam track 10. The cylinder 1 that has an inlet port 18 and an outlet port 19. Two pistons 4,4' can move coaxially in opposing directions within the cylinder 1. A drive rod 20, 20" of each piston 4, 4' is connected to a yoke-shaped driver 5,5' that is displaced in oscillation in the direction of the longitudinal axis L by the drivers 5. On the drivers 5,5', eight roller shafts 6 are mounted in pairs to support cam rollers 7. Between two opposing rollers 7 on an arm, the cam track 10 is situated. Upon oscillation of the pistons 4, 4', the drive rods 20,20'and drivers 5,5' will displace the cam track 10 via the rollers 7 so that it performs a rotary motion. When the pistons 4, 4' move towards each other, the gas within the cylinder 1 will be compressed. Near the end of the compression stroke, the fuel-air mixture is ignited and burned, so that the gases within the cylinder 1 expand. During the expansion stroke, the burned gases propel the pistons 4, 4' outwardly. This cycle is repeated constantly.

Figure 2:
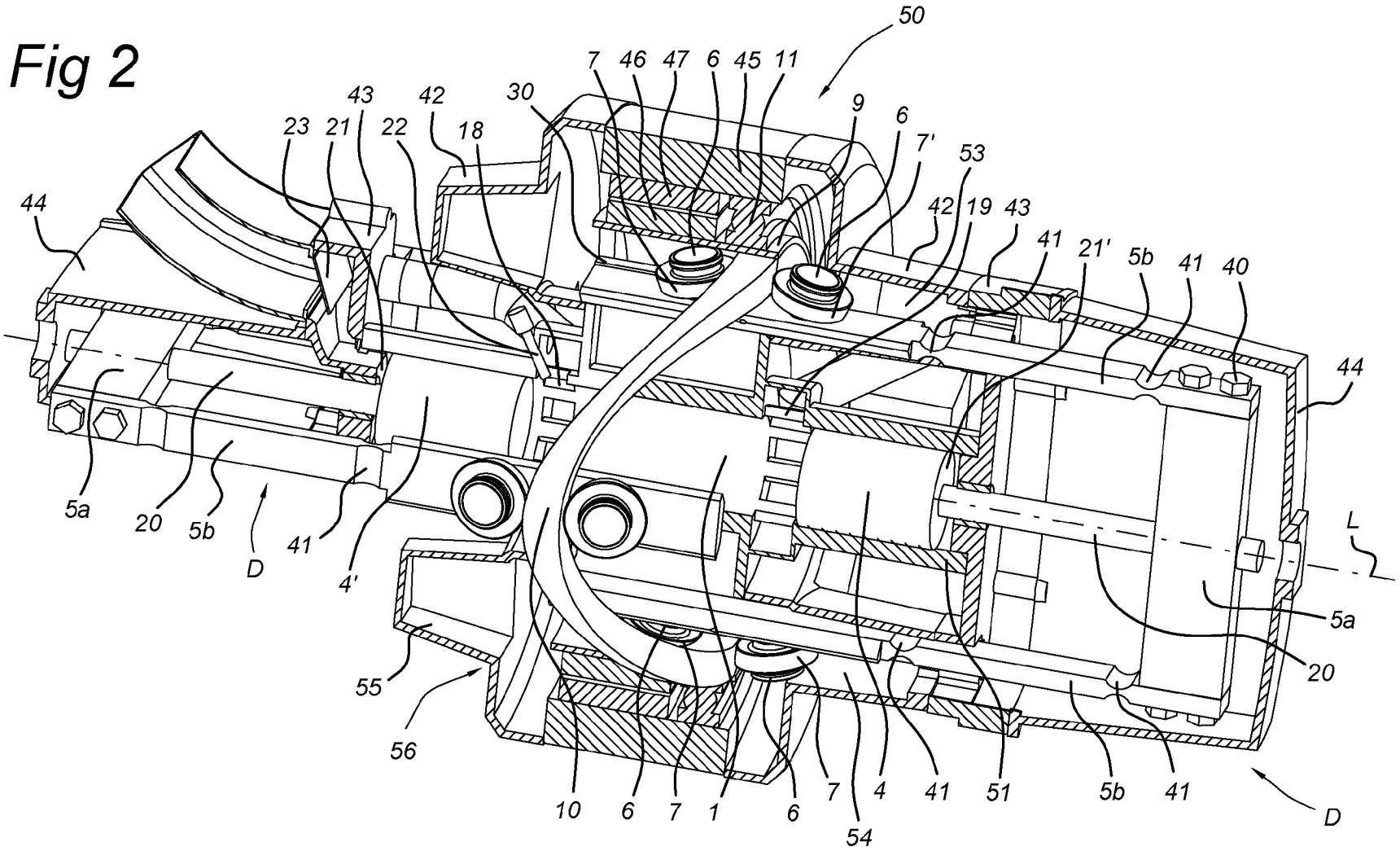
FIG. 2 shows a partially cut-away perspective view of a rotary drive system according to the invention having a yoke-shaped drive element comprising carrier arms releasably attached to a carrier support member.

FIG. 2 shows a rotary drive system 50 according to the invention applied to a cam engine whereby the annular cam track 10 is accessed from the inside. A cylinder 1 has inlet ports 18 and outlet ports 19 in the cylinder wall 51 and is located coaxially with the cam track ring 9. Two pistons 4,4' can move coaxially in opposing directions within the cylinder 1 along the longitudinal axis L. The drive rod 20, 20 of each piston 4,4' is connected with a yoke shaped beam or carrier support member 5*a*. This beam 5*a* is bolted with bolts 40 on to two separate carriers or drive elements 5*b*. Each separate drive element 5*b* comprises a flexible portion, and has a narrowed section 41, preferably situated near the connecting end of the drive element 5*b* or near a free end of the drive element 5*b*, to allow the drive elements 5*b* to bend and to adjust its tolerance in width at its linear displacement support 30. Each individual drive element 5*b* can move linearly between its linear displacement support structures 30. On each individual drive element 5*b*, two roller shafts 6 are mounted supporting the cam rollers 7,7'. Between two opposed rollers 7,7' the cam track 10 is situated. The cam track 10 is part of the cam track ring 9 that can rotate within the bearing 11. This bearing 11 is supported in the axial housing part, or ground supporting ring 45, of the housing 51. The rollers 7,7' follow the path of the cam track 10 when the drive elements 5*b*, the yoke-shaped driver beam 5*a*, the drive rods 20, 20' and the pistons, 4,4' move in an oscillating manner. When both pistons 4,4' are traveling to their most opposite position, the gas behind both pistons 4,4' in the back chambers 21, 21' will be compressed. Just before both pistons 4, 4'reach their most opposite positions, the outlet port 19 will open allowing the exhaust gas to exit. Following the intake port 18 will open letting the compressed fresh air behind the piston into to the cylinder 1. This compressed fresh air presses the exhaust gas out of the cylinder 1. Fuel is being injected by the injector 22 to the intake gas. When the pistons 4, 4' move towards each other, the inlet port 18 and the outlet port 19 will close and the gas between the pistons 4 will be compressed. During the compression stroke, inside the back chamber 21 of the cylinder 1, a reduced pressure will be created. This will open a reed valve 23 letting fresh outside air in. Near the end of the compression stroke, the fuel-air mixture is ignited and burned, causing the gas inside the cylinder 1 to expand. During the expansion stroke, the burned gasses propel the pistons 4, 4'. This cycle is repeated constantly.

Figure 3:
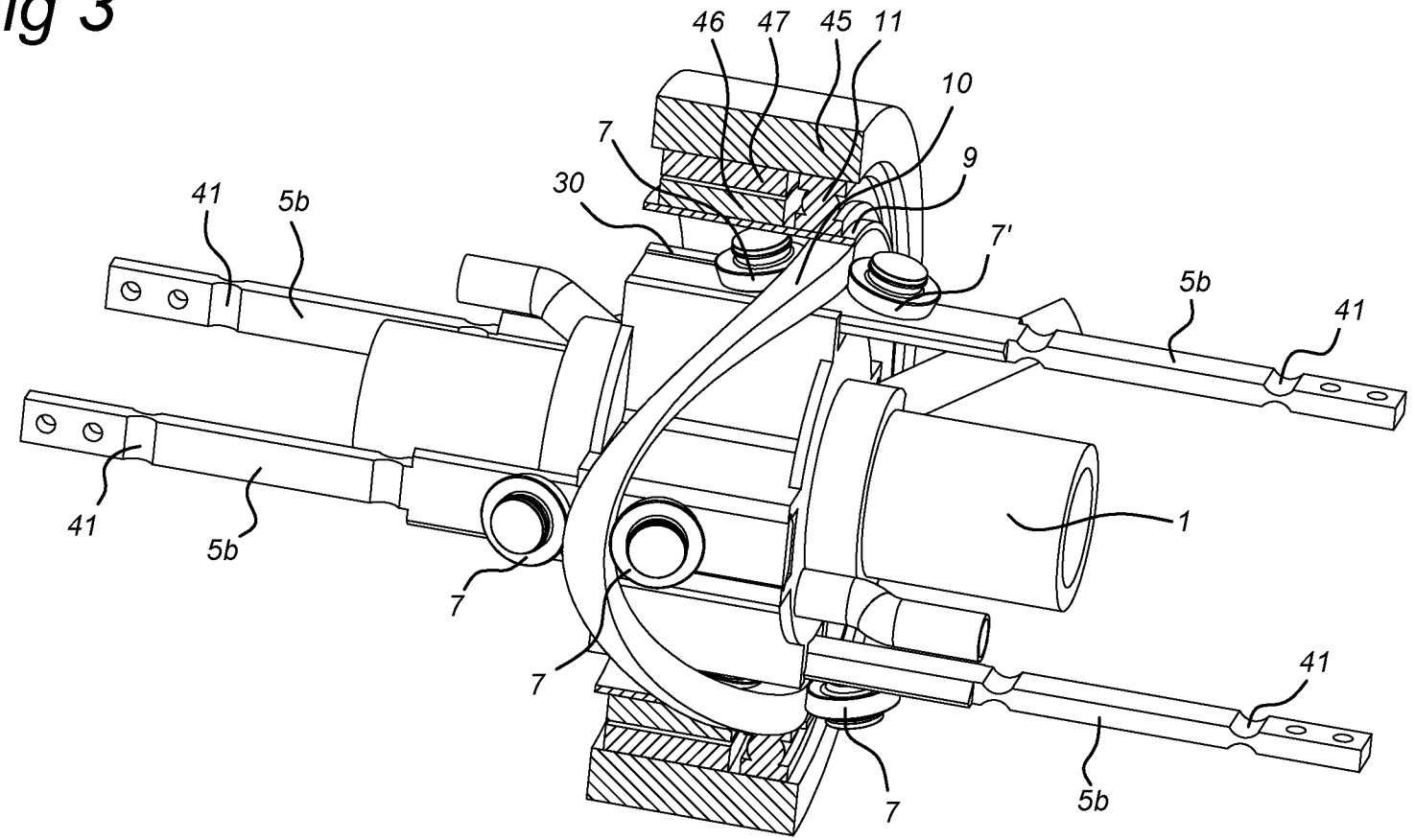
FIG. 3 shows a partial cut-away view of the rotary drive system of FIG. 2 having four separated carriers with each two rollers mounted on the central rotating cam.

FIG. 3 shows a partial sectional view of the rotary drive system according to the invention having a cam track ring 9 mounted within a bearing 11. On the cam track ring 9 a magnetic element 46 is mounted. The outside of the bearing 11 is mounted within a transverse housing part or ground supporting ring 45. On the ground supporting ring 45 the linear displacement support structure 30 and the cylinder 1 and a generator 47 are mounted. Four separated drive elements 5*b* each having two rollers 7, 7' are mounted on a cam track 10 inside cam track ring 9. This can be achieved by first placing the individual drive elements 5*b* with their rollers 7,7' from the inside into the cam track 10 and by sliding the linear displacement support structure 30 into position over the individual drive elements 5*b*.

Figure 4:
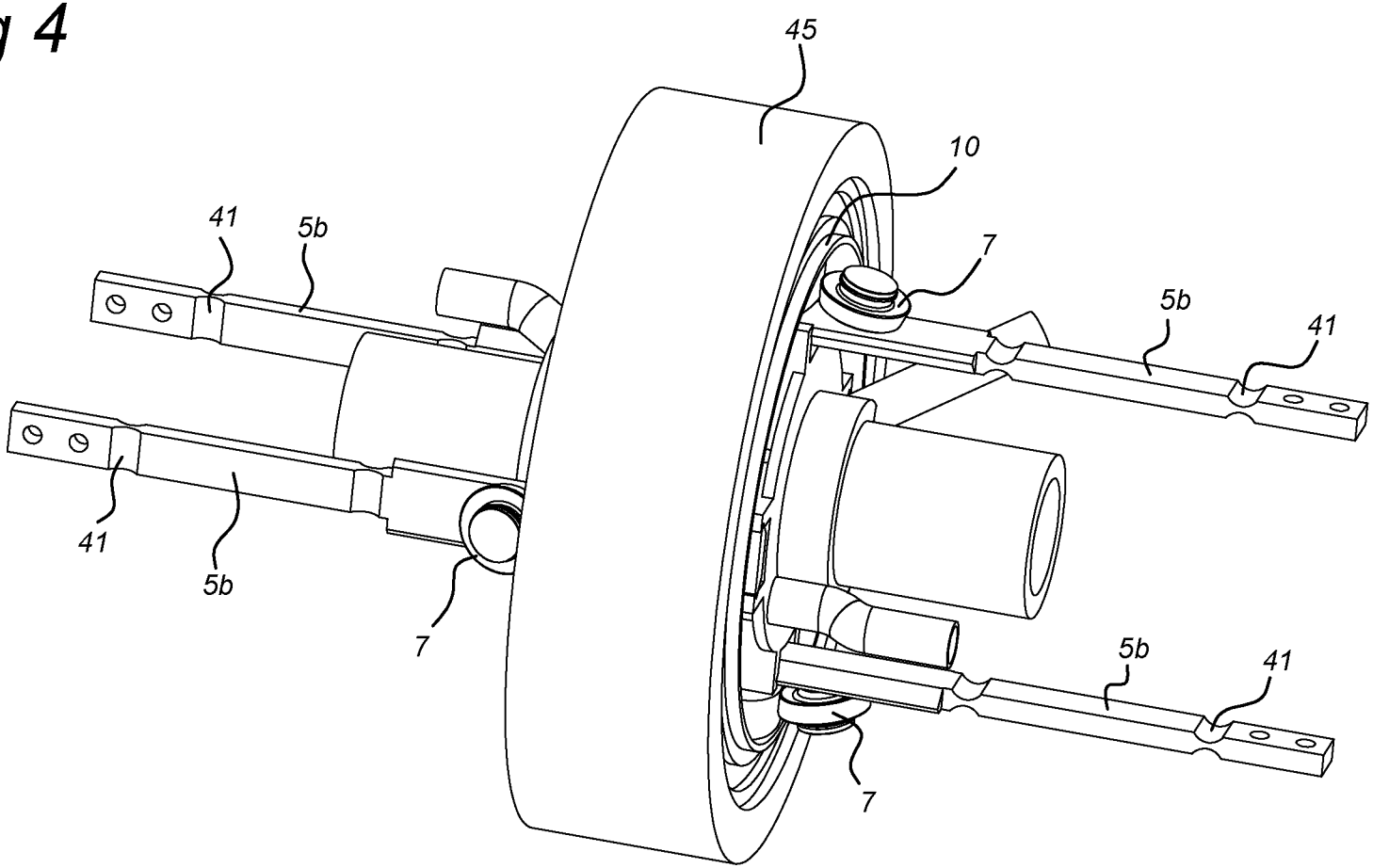
FIG. 4 shows a view of the drive system of FIG. 3 in a non-sectional perspective view, FIG. 5. shows a view of the rotary drive system according to the invention having four separated carriers with each two rollers mounted within housing end members or oil covers, FIG. 6. shows a view of the rotary drive system according FIG. 5 comprising a furthermore a mounted piston and piston rod that are guided by a cylinder end cover, FIG. 7. shows he rotary drive system according to FIG. 6 wherein the carrier members and the piston rod are interconnected by a yoke shaped carrier support member, and FIG. 8. shows a the rotary drive system of claim 7, wherein the carrier support member is covered by a cover 44.

FIG. 4 shows a view of the drive system according to the invention similar to that of FIG. 3 that is not partially cut away, including four individual drive elements 5*b* each carrying two rollers 7 mounted against the rotating cam 9.

Figure 5:
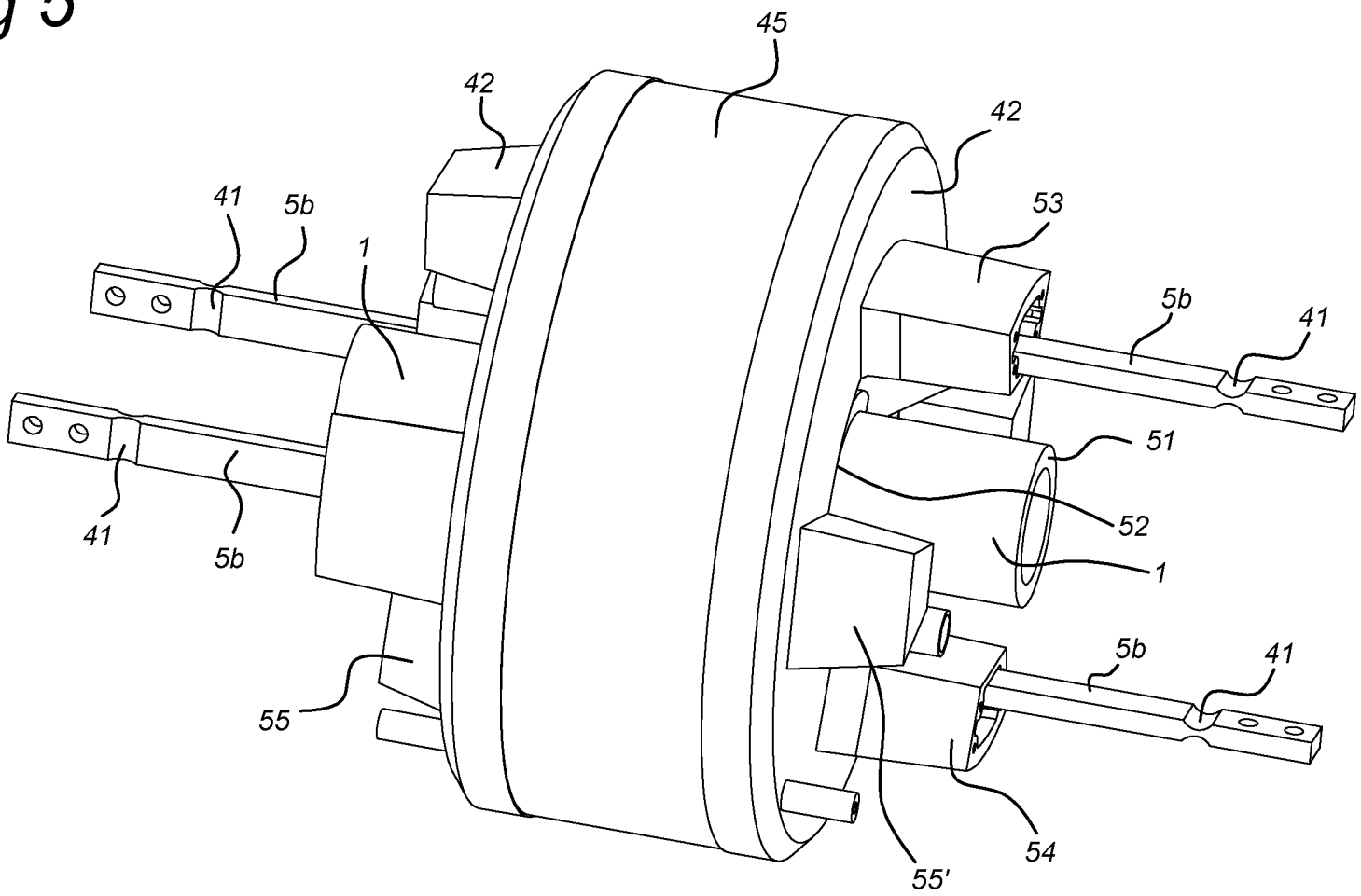

FIG. 5 shows a view of the drive system according to the invention having four individual drive elements 5*b* each carrying two rollers 7 mounted on the rotating cam 9 with on both sides a housing end member or oil cover 42. The oil cover 42 has a central aperture 52 accommodating the cylinder wall 51 and two apertures 53, 54 through which the four drive elements 5*b* to extend.

Figure 6:
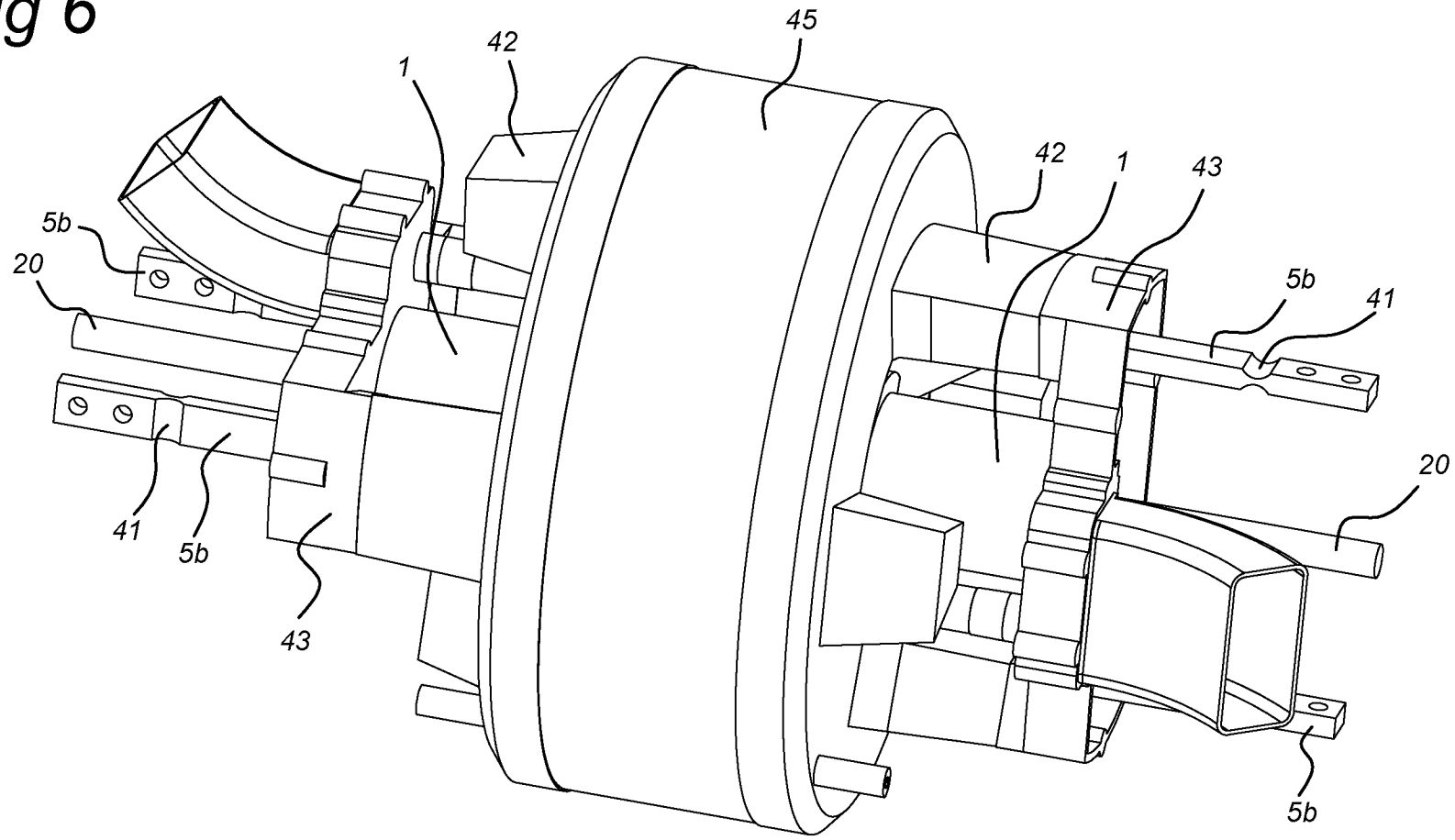

FIG. 6 shows a view of the rotary drive system of FIG. 5, whit mounted pistons and piston rods 20, 20' that are guided by a cylinder end cover 43 that covers the end face of cylinder wall 51 and through which the four individual drive elements 5*b* and the piston rods 20, 20' pass.

Figure 7:
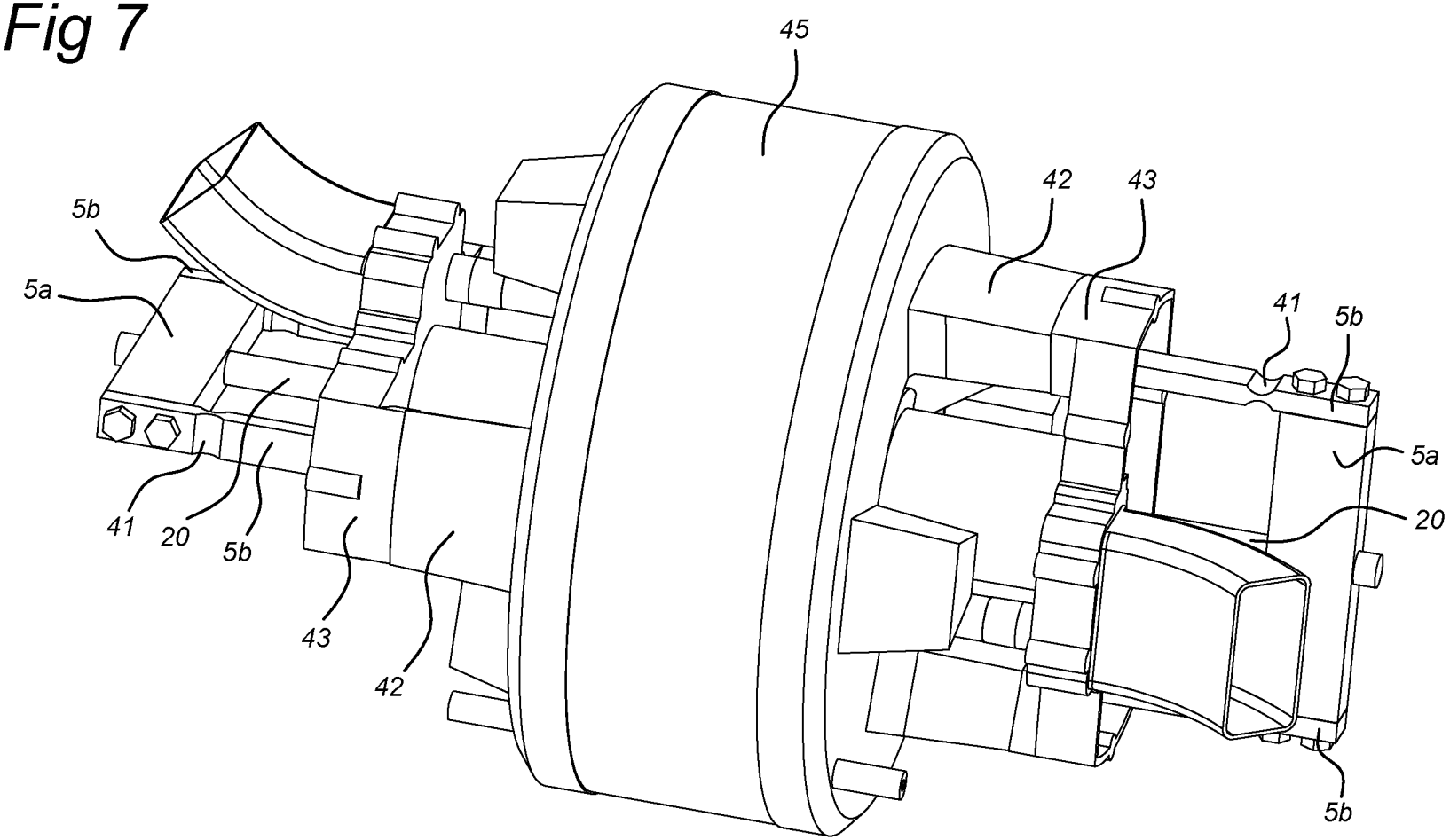

FIG. 7 shows a view of the drive system according to the invention wherein opposed drive elements 5*b* and the piston rod 20 on each side of the drive system are connected by a respective yoke-shaped beam 5*a*.

Figure 8:
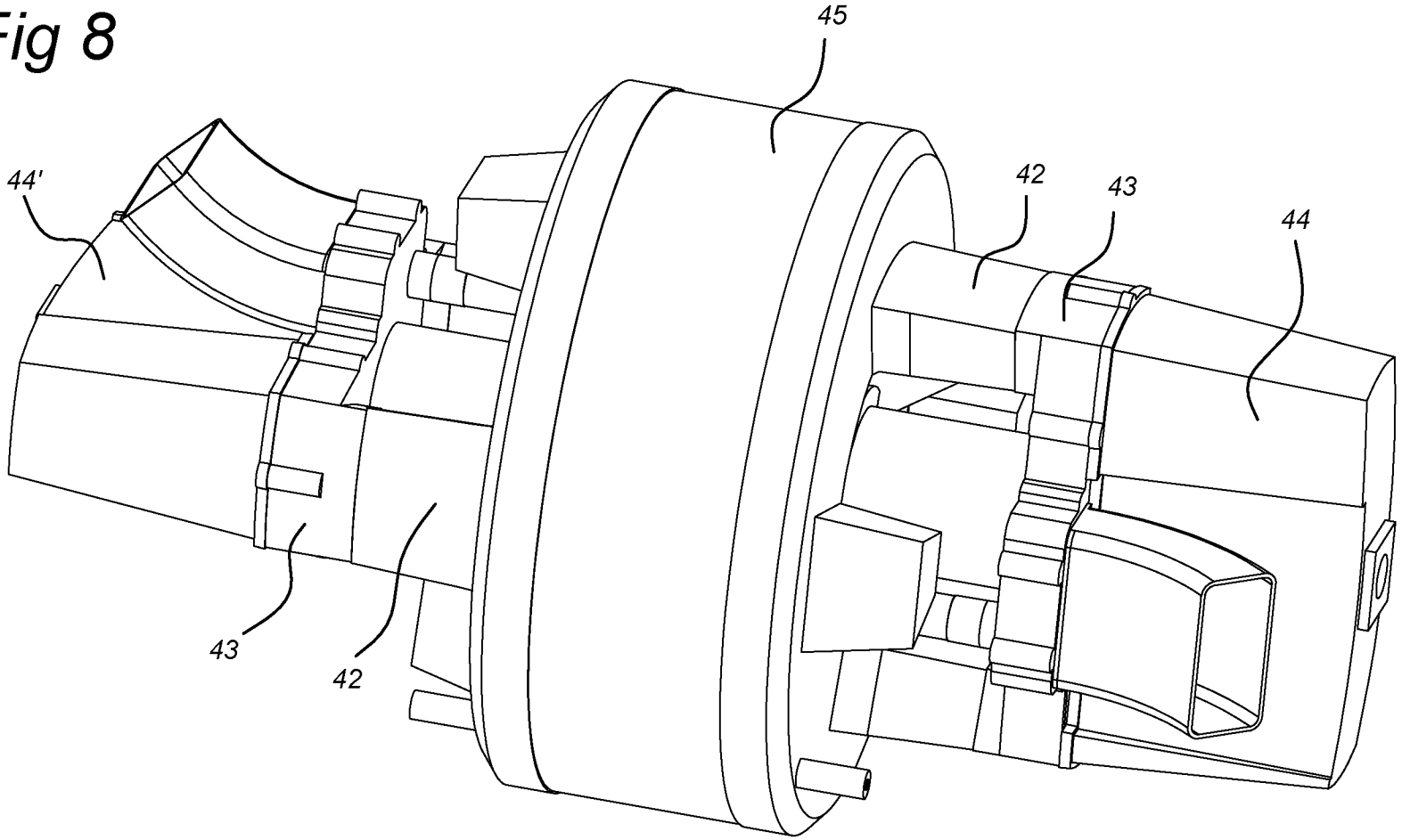

FIG. 8 finally shows a view of the drive system according to the invention wherein the yoke shaped beams 5*a* are covered by yoke covers 44, 44'.

The invention claimed is:

1. Rotary drive system (50) comprising a cylinder wall (51), a piston (4,4') axially slidable along a longitudinal axis (L) within the cylinder wall (51) and a piston rod (20,20') extending along the longitudinal axis and projecting at a drive side (D) of the system axially beyond the cylinder wall, the piston rod (20,20') at the drive side being attached to a carrier support member (5*a*), a rotatable annular cam member (9) extending at an axial cam position that is spaced at a distance from the drive side (D), coaxially around the cylinder wall (51), a carrier (5*b*) carrying at a support side a pair of rollers (7,7') engaging on opposed cam surfaces of the cam member, the carrier (5*b*) extending radially outwardly from the cylinder wall (51) from the cam position to the carrier support member (5*a*) and being with a connecting end detachably connected to the carrier support member, the carrier (5*b*) comprising an arm that is provided with a flexible section (41).

2. Rotary drive system (50) according to claim 1, a housing (56) having an axial housing part (45) extending radially outwardly from the carriers (5*b*) and surrounding the rollers (7,7') and the cam member (9), the housing having at the drive side (D) a first housing end member (42) with a central opening (52) accommodating the cylinder wall (51) and with at least one aperture (53,54) extending around the carrier (5*b*).

3. Rotary drive system (50) according to claim 2, wherein the housing (56) has an with axially extending closed chamber (55,55') for accommodating an end part of the carrier (5*b*).

4. Rotary drive system (50) according to claim 2, the drive system comprising an end plate member (43) connected to the housing end member (42) having a hole aligned with the aperture (53,54) for accommodating the carrier (5*b*) and having an end plate connected to the cylinder wall (51) and forming an end face of a cylinder enclosing the piston (4,4") and having a hole through which the piston rod (20,20') passes.

5. Rotary drive system (50) according to claim 1, wherein at the drive side (D) a releasable cap (44) is placed over the carrier support member (5*a*).

6. Rotary drive system (50) according to claim 1, comprising on two opposed sides of the longitudinal axis (L) a respective carrier (5*b*), each carrier having a pair of wheels (7,7').

7. Rotary drive system (50) according to claim 1, the cylinder (1) comprising two axially opposed pistons (4,4') inside the cylinder wall (51), each provided with at least one carrier (5*b*).

8. Rotary drive system (50) according to claim 3, the drive system comprising an end plate member (43) connected to the housing end member (42) having a hole aligned with the aperture (53,54) for accommodating the carrier (5*b*) and having an end plate connected to the cylinder wall (51) and forming an end face of a cylinder enclosing the piston (4,4") and having a hole through which the piston rod (20,20') passes.

9. Rotary drive system (50) according to claim 2, wherein at the drive side (D) a releasable cap (44) is placed over the carrier support member (5*a*).

10. Rotary drive system (50) according to claim 3, wherein at the drive side (D) a releasable cap (44) is placed over the carrier support member (5*a*).

11. Rotary drive system (50) according to claim 4, wherein at the drive side (D) a releasable cap (44) is placed over the carrier support member (5*a*).

* * * * *